United States Patent [19]

Zaita et al.

[11] Patent Number: 4,500,477

[45] Date of Patent: Feb. 19, 1985

[54] SLIDING THROTTLE VALVE TYPE CARBURETOR

[75] Inventors: Katsuyuki Zaita, Kawagoe; Michio Tahata, Niiza, both of Japan

[73] Assignee: Honda Giken Kogyo Kabushiki Kaisha, Tokyo, Japan

[21] Appl. No.: 546,502

[22] Filed: Oct. 28, 1983

[30] Foreign Application Priority Data

Nov. 4, 1982 [JP] Japan ..... 57-193809

[51] Int. Cl.[3] ..... F02M 9/06

[52] U.S. Cl. ..... 261/44 B; 261/DIG. 50

[58] Field of Search ..... 261/44 B, 44 C, DIG. 50

[56] References Cited

U.S. PATENT DOCUMENTS

| | | | |
|---|---|---|---|
| 998,993 | 7/1911 | Skinner | 261/44 C |
| 2,718,388 | 9/1955 | McCurdy | 261/44 B |
| 3,301,536 | 1/1967 | Swatman et al. | 261/44 B |
| 4,016,838 | 4/1977 | Yoshioka et al. | 261/44 B |
| 4,108,952 | 8/1978 | Iwao | 261/44 B |

FOREIGN PATENT DOCUMENTS

| | | | |
|---|---|---|---|
| 47-29625 | 3/1972 | Japan | 261/44 B |
| 52-15932 | 2/1977 | Japan | 261/44 B |
| 3026 | of 1915 | United Kingdom | 261/44 B |
| 164168 | 6/1921 | United Kingdom | 261/44 B |

*Primary Examiner*—Tim Miles

*Attorney, Agent, or Firm*—Posnack, Roberts, Cohen & Spiecens

[57] ABSTRACT

A sliding throttle valve type carburetor comprising a sliding throttle valve, an air intake passage and a fuel float chamber, the sliding throttle valve extending along a line of intersection with the intake passage and being disposed at an acute angle relative to the portion of the intake passage upstream from the sliding throttle valve. The sliding throttle valve forms an angle of intersection with the portion of the fuel surface in the float chamber upstream from the sliding throttle valve which is greater than the aforementioned acute angle.

23 Claims, 13 Drawing Figures

SLIDING THROTTLE VALVE TYPE CARBURETOR

BACKGROUND OF THE INVENTION (a) Field of the Invention

The present invention relates to the construction of a sliding throttle-valve type carburetor.

(b) Prior Art

In the conventional design of carburetors, it is usual to make the fuel passages extend perpendicularly to the fuel surface in the float chamber and to dispose the air intake passage parallel to the fuel surface, in order to simplify the fuel passage arrangement and to compensate for changes in the closing force of the float valve caused by the displacement of the center of the fuel surface due to a change in the fuel surface attributable to forward or backward inclination of the vehicle. In some cases, however, conditions such as the arrangement and mounting angles of the cylinders of the engine require the air intake passage to be at an inclination relative to the fuel surface due to restriction of the space for accommodating the air intake pipe and the like. In such a case, and with reference to FIG. 10, if a sliding throttle valve 12 and a float chamber 15 are arranged perpendicularly to the fuel surface l with respect to the inclined intake passage 14, the sliding throttle valve 12 interferes with the portion of the air intake passage upstream from the sliding throttle valve 12 in the region A, while the portion of the passage 14 downstream from the sliding throttle valve 12 interferes with the float chamber 15 in the region B. To avoid this problem, it is necessary to increase the overall length of the intake passage 14 and to lower the float chamber 15. However, the length of the intake system of the internal combustion engine should be small in order to reduce the intake resistance, and is determined also by the intake inertia charging effect. It is quite difficult to vary the length of the intake passage of the carburetor (constituting a part of the intake system of the engine) without adversely affecting the performance of the engine. The increase of the length of the intake passage is also limited for reasons concerning installation.

If the intake passage 14 of the carburetor is arranged to cross the sliding throttle valve 12 at a sufficiently large angle, interference occurs in the region C (FIG. 11) and the fuel surface must be positioned at a higher level whereby the fuel system is not adapted for forward inclination.

As a countermeasure for eliminating the undesirable effect of the inclination, it is considered to arrange the fuel passage at right angles to the fuel surface as seen in FIG. 12. In such case, however, it is necessary to deflect the main fuel passage towards the inclined intake passage, so that the construction is complicated, particularly in a carburetor having a fuel metering needle valve 33 resulting in a large resistance encountered by the fuel flowing in the fuel passage, which produces various problems such as vapor lock, percolation and the like due to inferior relief of the fuel vapor.

SUMMARY OF THE INVENTION

Accordingly, an object of the invention is to provide a compact carburetor which satisfies the requirement for intake characteristics, wherein the intake passage in the carburetor is disposed at an angle to the fuel surface and is arranged to intersect the sliding throttle valve at an acute angle, the angle of intersection between the sliding throttle valve and the portion of the fuel surface upstream of the sliding throttle valve being greater than said acute angle.

Another object of the invention is to provide a compact carburetor which avoids interference between the intake passage and the sliding throttle valve and interference between the intake passage and the float chamber, and wherein the line of operation of the sliding throttle valve is disposed on the bisector of the greater one of the angles of intersection between the fuel surface and the intake passage.

It is a further object of the invention to provide a compact carburetor having a superior intake characteristic and stability of operation against inclination, by arranging the intake passage at an angle of inclination relative to the fuel surface while determining the positional relationship between the constituents of the carburetor to meet specific conditions concerning the angles of intersection. The above and other objects, features and advantages of the invention will become clear from the following description of preferred embodiments taken in conjunction with the accompanying drawings.

DESCRIPTION OF THE PREFERRED EMBODIMENT

Figure 1:
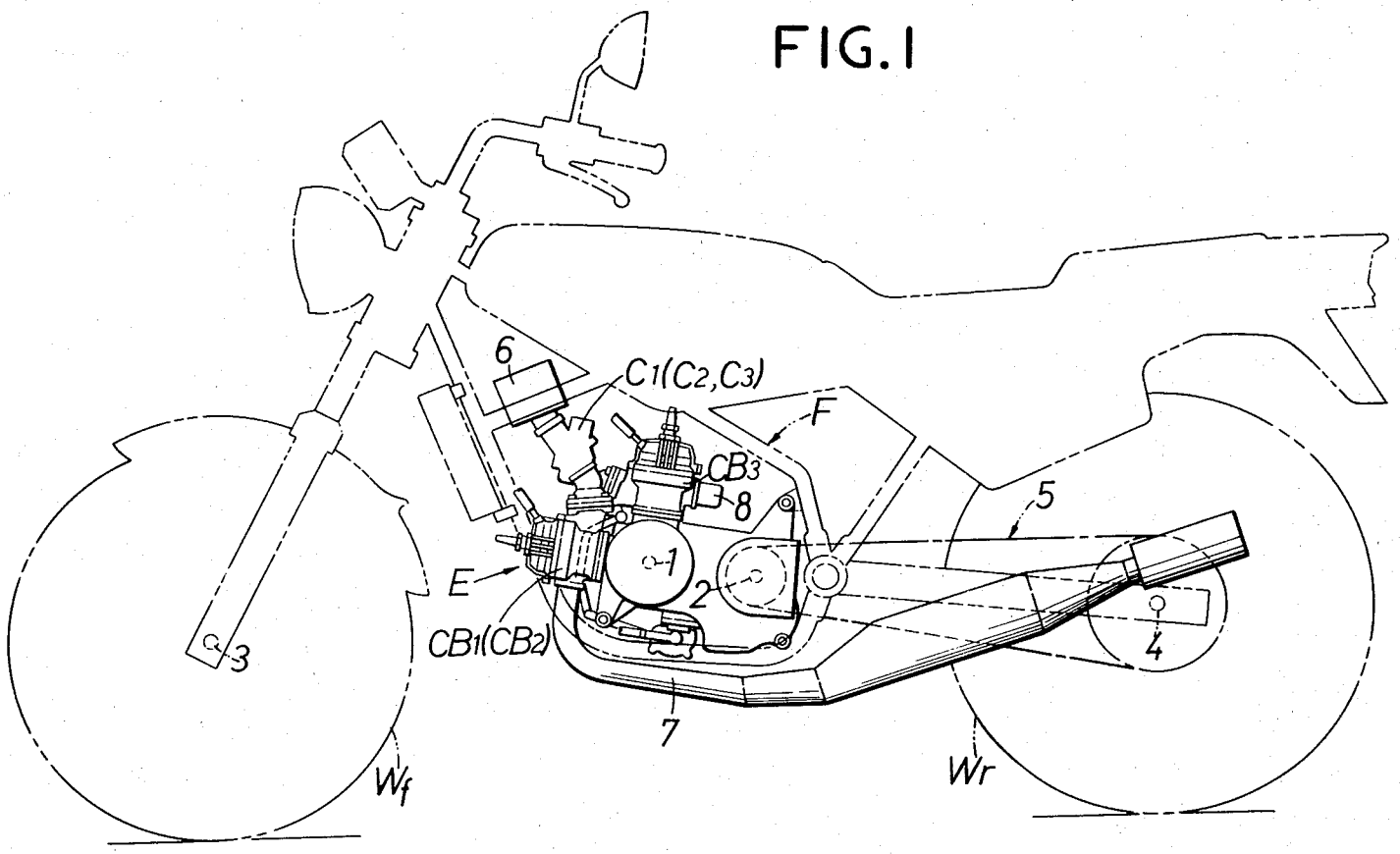
FIG. 1 is a side elevational view of a motorcycle equipped with a sliding throttle valve type carburetor in accordance with the invention.
Figure 2:
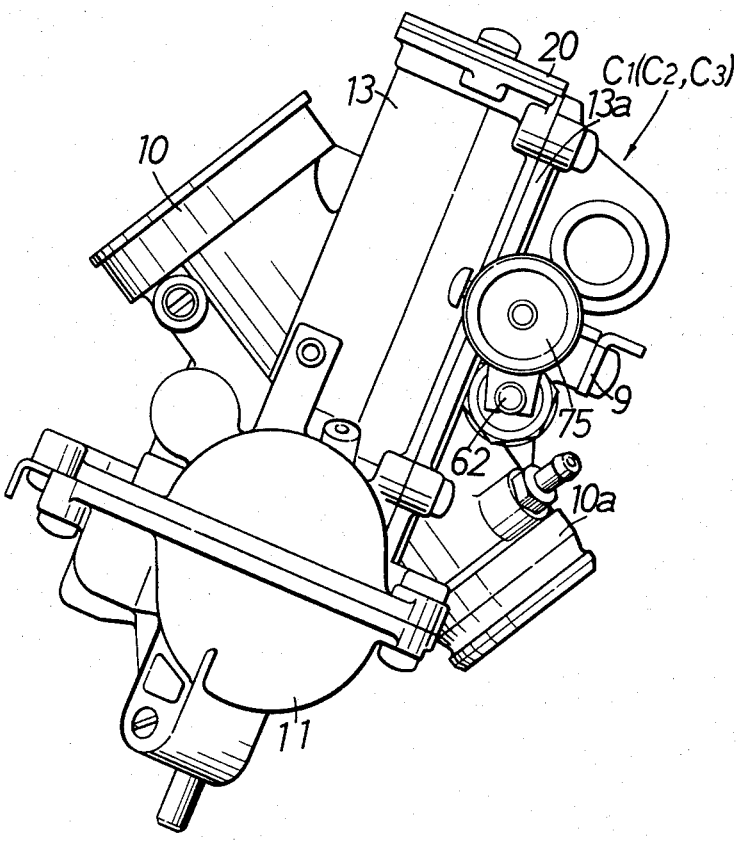
FIG. 2 is a side elevational view of the carburetors C1 to C3 as shown in FIG. 1.
Figure 3:
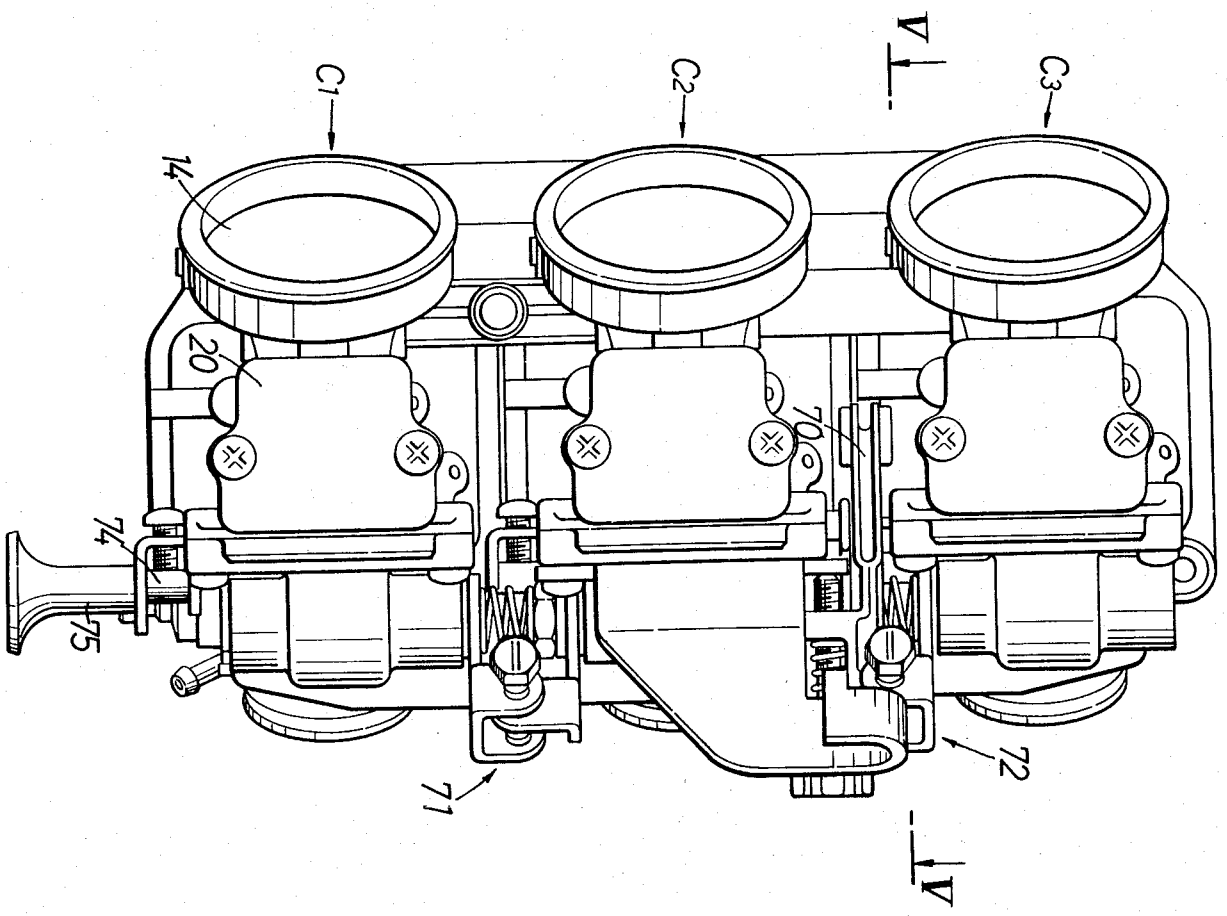
FIG. 3 is a plan view of the carburetors shown in FIG. 2.

A preferred embodiment of the invention will be described hereafter with reference to the accompanying drawings. Referring first to FIG. 1, the frame of a motorcycle carries a 2-cycle 3-cylinder engine E having a first cylinder block CB1 and a second cylinder block CB2 which are inclined forwardly and a third cylinder block CB3 which is disposed between the first and the second cylinder blocks to project upwardly at 90° to the first and second cylinder blocks to form a substantially V-like arrangement. The output shaft 2 connected to the crankshaft 1 of engine E is disposed parallel to the axle 3 of the front wheel Wf and the axle 4 of the rear wheel Wr. The driving power from the output shaft 2 is transmitted to the axle 4 of the rear wheel Wr through a transmission chain 5.

Referring now to FIGS. 2 to 5 showing carburetors C1 to C3 on a larger scale, the cylinder blocks CB1, CB2 and CB3 of the internal combustion engine E have intake ports to which are independently connected the carburetors C1, C2 and C3 constructed in accordance with the present invention. The carburetors C1 to C3 are connected at their upstream ends to a common air cleaner 6 (FIG. 1). An exhaust pipe 7 or an exhaust pipe 8 is connected to the exhaust ports of the cylinder blocks CB1 to CB3.

Figure 4:
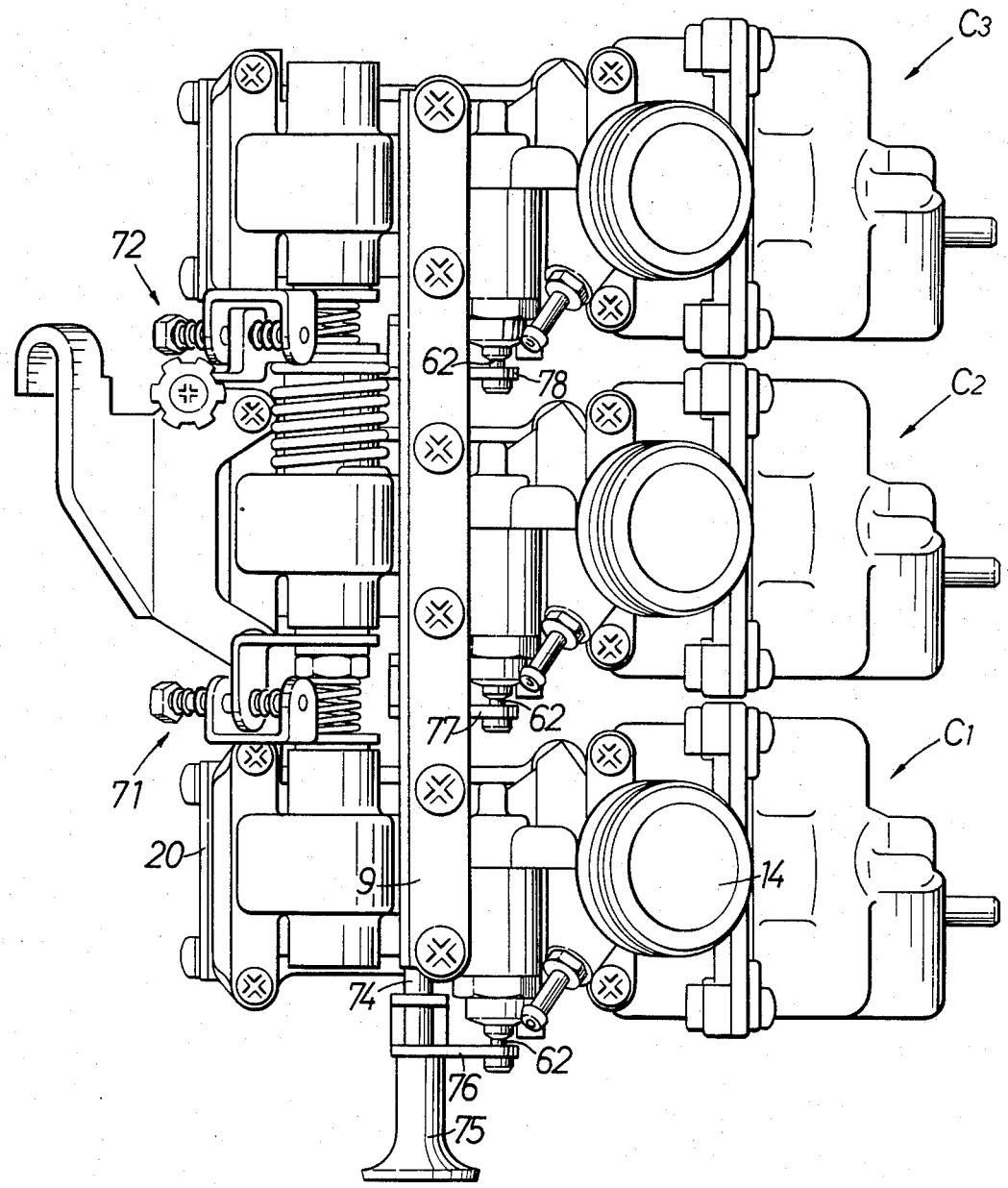
FIG. 4 is a right-side elevational view of the carburetors shown in FIG. 3.
Figure 5:
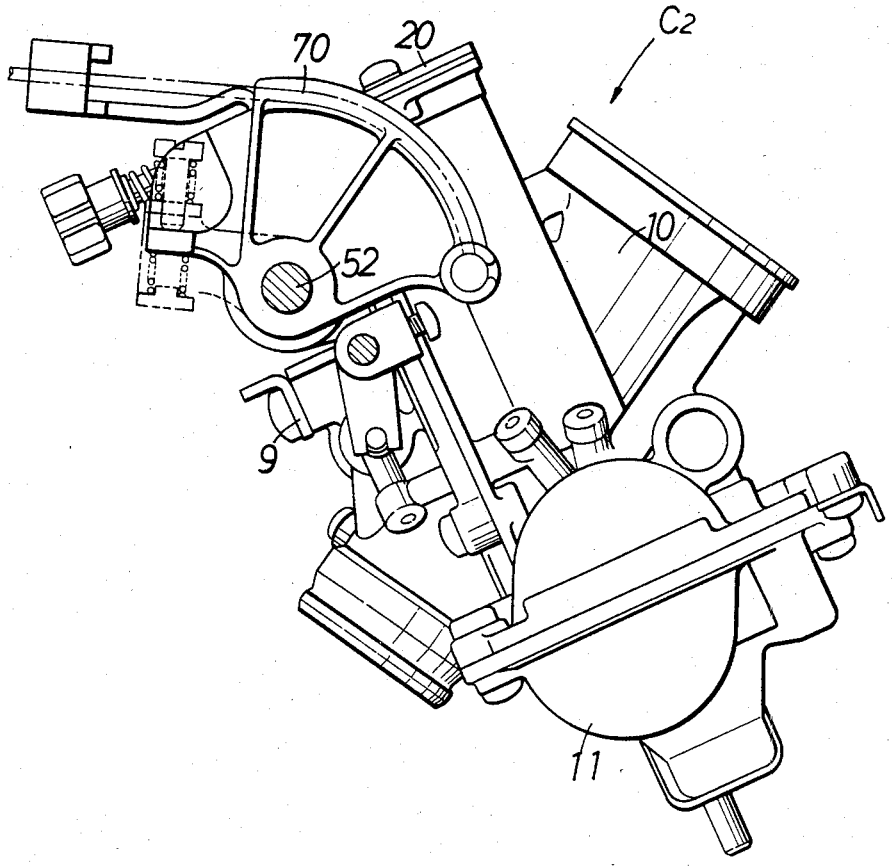
FIG. 5 is a sectional view taken along line V—V in FIG. 3.

The carburetors C1 to C3 are of identical construction and are connected integrally by means of a connecting plate 9 (FIG. 4). Therefore, the construction of the carburetors will be described hereinafter mainly with reference to the carburetor C1 but the same description also applies to the other carburetors C2 and C3.

Figure 6:
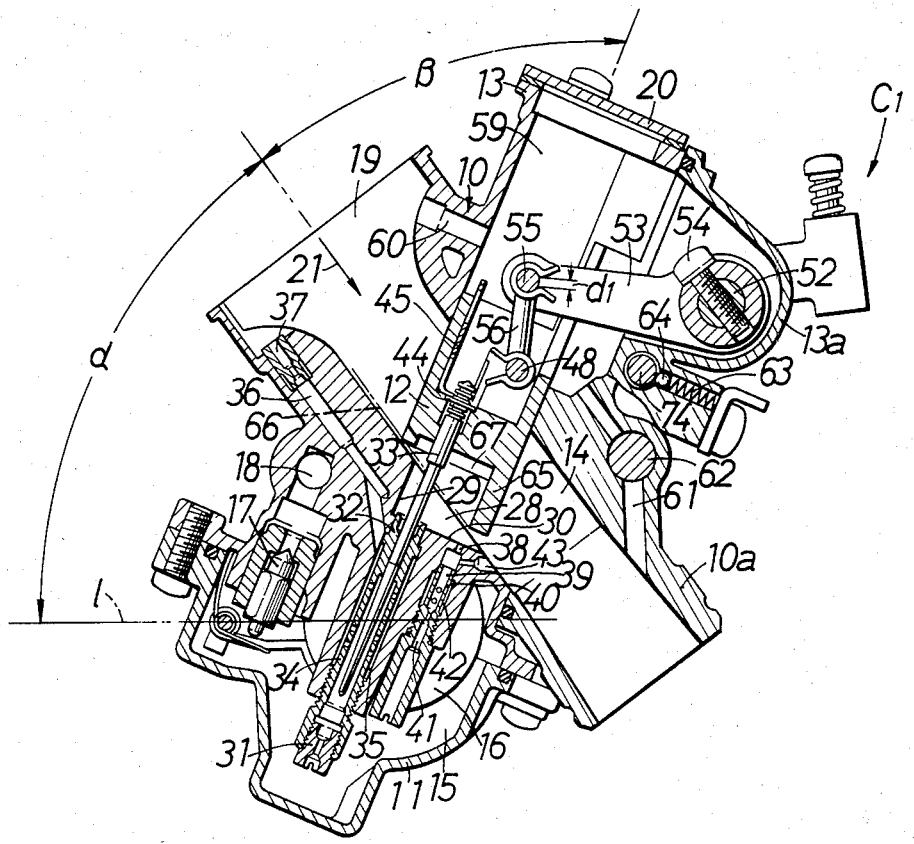
FIG. 6 is a vertical sectional view of carburetor C1.

Referring now to FIG. 6 showing the carburetor C1 in vertical section, the carburetor C1 has a carburetor body 10, a float chamber 15 connected to the lower end of the carburetor body 10, a sliding throttle valve 12, and a throttle valve guide cylinder 13 integrally formed with the carburetor body 10.

The carburetor body 10 is provided with an air intake passage 14 therein. The intake passage 14 is inclined at an angle $\alpha$ with respect to the horizontal, i.e. the fuel surface l in the float chamber 15 when the motorcycle is in a horizontal attitude, such that the distance between the intake passage 14 and the fuel surface increases towards the upstream end as viewed in the direction of flow of the intake air 21. The float chamber 15 accommodates a float 16 which basically has a form of a slice of a column. The arrangement is such that the float 16 displaces a float valve 17 up and down to control the rate of supply of the fuel into the float chamber 15 to maintain a constant level of the fuel surface l in the float chamber 15. Since the float 16 basically has the form of a slice of a column, the center of buoyancy of the float coincides with the geometric center thereof, and the arrangement is such that the center of buoyancy is located at the same level as the fuel surface. A support point 58 of the float 16 is located at the upstream side of a main fuel passage 57 as viewed in the direction of flow of the intake air 21. A valve seat 17*a* of the float valve 17 is disposed within the angular range formed between the fuel surface l and the bottom surface of the intake passage 14. Therefore, any inclination of the motorcycle in the forward or rearward direction does not cause a change in the position of the buoyancy center nor a change in the force for closing the float valve 17. Thus, the carburetor has a high stability of operation in respect of the inclination of the motocycle body. In addition, the size of the carburetor can be reduced advantageously because the fuel passage 18, valve seat 17*a* and the float valve 17, which require substantial space in the vertical direction, are arranged within an angular range which is formed as a result of inclination of the intake passage 14, and because the support point 58 is disposed on the same side as these members.

The throttle valve guide cylinder 13 is so arranged that the line of operation of the throttle valve is disposed substantially on the bisector of the greater of the angles formed between the intake passage 14 and the fuel surface l, so that mutual interference between an air horn 19 connected to the upstream end of the intake passage 14 and the throttle valve guide cylinder 13 is avoided even when the intake passage 14 has a reduced length. Thereby, it is possible to make the intake passage 14 of comparatively small length and it is also possible to reduce the amount of projection of the throttle valve guide cylinder 13 from the carburetor 10. This contributes to a reduction in the size of the carburetor C1.

Figure 6A:
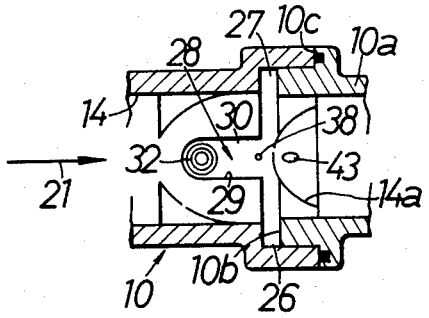
FIG. 6A is a cross-sectional view showing the central bottom portion of the intake passage shown in FIG. 6.
Figure 7:
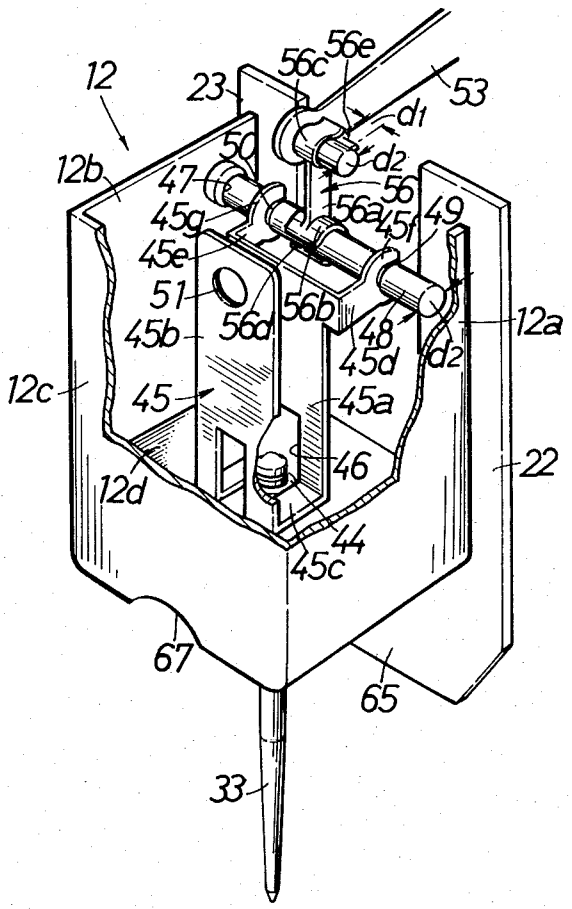
FIG. 7 is a fragmentary perspective view showing a sliding throttle valve on a larger scale.

As shown on a larger scale in FIG. 7, the throttle valve guide cylinder 13 receives a sliding throttle valve 12 for free sliding motion in the up and down directions, i.e. for free displacement in the direction which forms an angle $\beta$ with respect to the intake passage 14. The throttle valve guide cylinder 13 is closed by a plug 20 in an airtight manner. The downstream portion 10*a* of the carburetor body 10, as viewed in the direction of flow of the intake air 21, has a surface 10*b* slidingly supporting the sliding throttle valve and a carburetor body mounting surface 10*c* which is connected to the surface 10*a* through a step, as shown in FIG. 6A. The downstream portion 10*a* of the carburetor body 10 is detachably connected to the carburetor body 10. In addition, the region of intersection between the above-mentioned step and the intake passage 14 is cut away at a right angle relative to the carburetor body mounting surface 10*c* on the same plane as the bottom surface 30 of a recess 28 beneath intake passage 14, so that the correlation line 14*a* between the upstream portion and the downstream portion of the carburetor body 10 becomes continuous as will be seen from FIG. 6A to make these portions of the intake passage continuous and integral with each other.

Since the downstream portion 10*a* of the carburetor body 10 is detachable from the upstream portion of the carburetor 10 and the remaining side wall of the throttle valve guide cylinder 13, the sliding throttle valve 12 can be mounted in the throttle valve guide cylinder 13 without substantial difficulty. It is to be noted also that the mounting of the sliding throttle valve 12 in the throttle valve guide cylinder 13 can be made while maintaining the connection between the sliding throttle valve 12 and a driving mechanism which will be described later.

Figure 8:
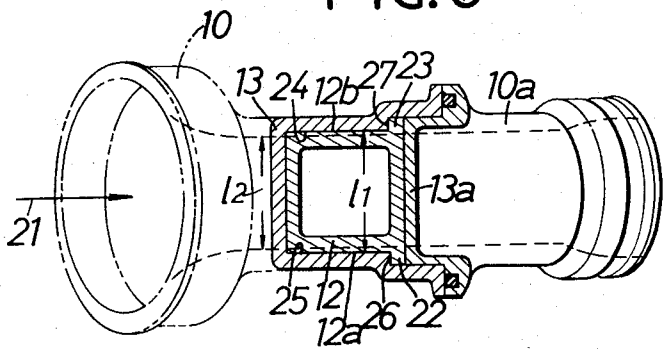
FIG. 8 is a simplified sectional view showing the state of connection between the sliding throttle valve and the intake passage.

As shown in FIG. 8, the sliding throttle valve 12 has a tubular form of basically rectangular cross-section with its smaller sides extending in the direction of flow of the intake air. Collars 22 and 23 are formed to project laterally outwardly from both sides of the sliding throttle valve 12 at the downstream portion thereof. To cooperate with the sliding throttle valve 12, the body 10 is provided with sealing surfaces 24 and 25 making sliding contact with both outer surfaces 12*a*, 12*b* of the sliding throttle valve 12 and guide grooves 26 and 27 which receive and guide the collars 22 and 23. In addition, the distance $l_1$ between the outer surfaces 12*a* and 12*b* of the sliding throttle valve 12 is 1 to 2 mm greater than the distance $l_2$ of the intake passage 14 at the location of the sliding throttle valve 12.

It is thus possible to effectively eliminate the interference between air horn 19 of the upstream end of the intake passage and the throttle valve guide cylinder 13, by making the sliding throttle valve 12 have a basically rectangular transverse cross-section, i.e. perpendicular to the direction of sliding of the valve with its smaller sides extending in the direction of flow of the intake air. In addition, it is possible to obtain a comparatively large area of contact between the outer surfaces 12*a* and 12*b* of the sliding throttle valve 12 and the sealing surface 24 and 25, without increasing the amount of cutting into the inner surface of the intake passage, so that the flow of air to the rear side of the throttle valve is avoided even when the valve is maintained at a small opening. In addition, the collars 22 and 23 can have sufficiently small thickness and magnitude of projection because they are required only to guide the sliding motion of the sliding throttle valve 12. This in turn allows the breadth and depth of the guide grooves 26 and 27 to be correspondingly small. In consequence, it is possible to reduce the volume of the space facing the intake passage 14 to diminish the generation of the eddies and, hence, to make the intake resistance sufficiently small. It is also possible to reduce the thickness of the carburetor body 10 to realize a compact construction. Since the collars 22 and 23 are urged downwardly by the pressure differential across the sliding throttle valve 12, the guide grooves 26 and 27 can make close contact with the cooperating guide grooves 26 and 27 thereby to further diminish the flow of air to the area behind the throttle valve.

Referring again to FIG. 6A, recess 28 is formed in the body 10 at the bottom surface of the intake passage 14 opposite the bottom surface 12*d* of the sliding throttle valve 12. The recess 28 has a rectangular or an inverted U-shaped form elongated in the direction of flow of the intake air 21 when viewed from the upper side. The recess 28 has an L-shaped section along the line of operation of the sliding throttle valve, with both side walls 29 parallel to the line of operation of the sliding throttle valve and a bottom surface 30 perpendicular to the side walls 29.

A main fuel jet assembly is arranged to open at the bottom surface 30. The main fuel jet assembly provides a linear fuel passage 57 having an axis coinciding with the line of operation of the sliding throttle valve 12. The main fuel jet assembly comprises a fuel jet member 31 disposed in the float chamber 15 at the bottom of fuel passage 51. At the bottom surface 30 is also provided a main fuel nozzle 32 having a main fuel nozzle port communicating with the portion of the float chamber 15 beneath the fuel surface l. The main fuel nozzle 32 receives a needle valve 33 secured to the sliding throttle valve 12 and, hence, movable as a unit with the latter. An air bleed tube 34 is connected to the lower end of the main fuel nozzle 32 concentrically with the latter. An annular chamber 35 surrounding the air bleed tube 34 communicates with an air bleed passage 36 formed in the carburetor body 10. The air bleed passage 36 in turn is connected to the upstream end of the intake passage 14 through an air jet 37. The main fuel jet assembly, main fuel nozzle 32 and the air bleed pipe 34 form the linear and continuous fuel passage 57.

By making the main nozzle port of the main fuel nozzle 32 open at the bottom surface 30 of the recess 28, it is possible to reduce the fuel suction head of the fuel from the fuel surface l as compared with the case where the recess 28 is not formed. In addition, higher fuel jetting characteristics with good response can be attained because the main nozzle port of the main fuel nozzle 32 is located at a level below the bottom surface of the inclined intake passage 14 to prevent striking of the nozzle head by the inclined intake flow of air. In addition, since the side walls 29 of the recess 28 are disposed in the vicinity of the upstream end of the main fuel nozzle port of the main fuel nozzle 32, it is possible to avoid reversing of the fuel to the upstream side due to blow back in the intake system and also undesirable thickening of the mixture due to sucking of the fuel in the suction stroke.

It is to be noted also that turbulence of the air flow due to the presence of the recess is minimized and the venturi area can be diminished because the recess 28 has a rectangular or U-shaped form elongated in the direction of flow and open at the downstream end. This in turn makes it possible to reduce the intake vacuum when the opening of the throttle valve is small and to reduce the change of the intake air flow rate with respect to the change in the throttle valve opening.

A slow fuel nozzle port 38 opens at the bottom surface 30 downstream of the main fuel nozzle 32. A slow fuel nozzle 39 constituting a slow fuel passage is disposed just below the slow fuel nozzle port 38 and extends parallel to the main fuel nozzle 32. The slow fuel nozzle 39 communicates with the portion of the float chamber 15 beneath the fuel surface l, through an air bleed tube 40 and a slow fuel jet 41. Since the main fuel passage 57 and the slow fuel passage 79 are parallel to each other, the passages 57 and 79 are easily formed by machining. An annular chamber 42 surrounding the air bleed tube 40 communicates with the upstream end of the intake passage 14 through an air bleed passage which is not shown. An auxiliary idle nozzle port 43 is formed to open into the intake passage 14 downstream of the recess 28. The auxiliary idle nozzle port 43 is in communication with the slow fuel nozzle 39 and the slow fuel nozzle port 38. When the sliding throttle valve 12 is fully closed, emulsified fuel from the slow fuel nozzle 39 is discharged from the auxiliary idle nozzle port 43, accompanying the air which flows through the slow fuel nozzle port 38. Then, as the sliding throttle valve 12 is slightly opened from the fully closed position, fuel is sucked from the slow fuel nozzle port 38 and is discharged into the intake passage 14.

Referring again to FIGS. 6 and 7, the upper portion of the fuel metering needle valve 33 extends through the bottom 12*d* of the sliding throttle valve 12. An E-shaped stopper ring 44 is pressed by a pressing plate 45 against the bottom of the sliding throttle valve 12 thereby to hold the upper end of the fuel metering needle valve 33 projected into the valve chamber. The pressing plate 45 is made of a resilient material and has parallel portions 45*a*, 45*b* parallel to each other and extending in the axial direction of the fuel metering needle valve 33, a pressing portion 45*c* connecting the lower ends of the parallel portions 45*a*, 45*b*, a pair of arms 45*d*, 45*e* formed on the free end of the parallel portion 45*a*, and extending away from the other of the parallel portion 45*b*, and engaging portions 45*f*, 45*g* formed on the free ends of the arms 45*d* and 45*e*. A notch 46 is formed above the pressing portion 45*c* and a part of the parallel portions 45*a*, 45*b* so as to permit the upper end of the fuel metering needle valve 33 to project therethrough.

A hole 47 having an axis perpendicular to the direction of movement of the sliding throttle valve 12 is formed in each of the side walls 12*a* and 12*b* of the valve 12 so as to receive a support shaft 48. Axially spaced engaging grooves 49 and 50 are formed over the entire circumference of the support shaft 48 so as to be engaged by the engaging portions 45*f*, 45*g* of the pressing plate 45. The engaging portions 45*f* and 45*g* are of substantially open C-shape to engage the support shaft 48. The engaging portions 45*f* and 45*g* are fitted in the engaging grooves 49 and 50 as the pressing plate 45 is pressed from the upper side with the parallel portion 45*a* elastically deflected towards the other parallel portion 45*b*. The parallel portion 45*a*, arm portions 45*d*, 45*e* and the engaging portions 45*f* and 45*g* are so dimensioned that the pressing portion 45*c* makes pressure contact with the E-shaped stopper ring 44 when the above-described engagement is achieved. When the pressing portion 45*c* is held in contact with the E-shaped stopper ring 44, the upper end of the parallel portion 45*b* projects above the sliding throttle valve 12. An engaging hole 51 is formed in the projecting portion of parallel portion 45*b* so as to be engaged by a screwdriver or similar tool for disassembly. This pressing plate 45 can be mounted simply by being pressed with the pressing portion 45*c* positioned to face the bottom 12*d* of the sliding throttle valve 12. In so doing, it is possible to bring the engaging portions 45*f* and 45*g* into engagement with the engaging grooves 49 and 50. At the same time, the E-shaped stopper ring 44 is pressed against the bottom 12*d* of the sliding throttle valve 12 thereby to secure the fuel needle valve 33. The arrangement is such that, when the engaging grooves 49 and 50 are engaged by the engaging portions 45*f* and 45*g*, the distance between the upper ends of both parallel portions 45*a* and 45*b* is less than that in the natural state, so that the parallel portion 45*b* is resiliently pressed against the side wall 12*c* of the upstream portion of the sliding throttle valve 12, thereby to prevent any drop or disengagement of the pressing plate 45, for example, by vibration. The pressing plate 45 can be detached simply by being pulled by means of a screw driver or similar tool engaged in the engaging hole 51.

The support shaft 48 is prevented from coming out of the hole 47, because the engaging portions 45*f*, 45*g* are in engagement with the engaging grooves 49, 50 when the pressing plate 45 is correctly mounted.

In order to drive the sliding throttle valve 12 up and down, the detachable portion 13*a* of the sliding throttle valve guide cylinder 13 is provided with a rotary shaft 52 having an axis perpendicular to the direction of movement of the sliding throttle valve 12, i.e. parallel to the axis of the support shaft 48. An arm 53 is fixed at one end to the rotary shaft 52 by means of a screw member 54, while the other end of the arm 53 carries fixedly or rotatably a support shaft 55 which extends parallel to the support shaft 48. Both support shafts 48 and 55 are connected to each other through a connecting member 56.

The connecting member 56 is made of a flexible material, such as a synthetic resin, and is composed of a straight connecting portion 56*a* and substantially C-shaped gripping portions 56*b* and 56*c* integrally formed at both ends of the connecting portion 56*a*. The gripping portions 56*b* and 56*c* open in opposite directions and the breadth d1 of opened portions 56*d* and 56*e* is smaller than the diameter d2 of the support shafts 48 and 55. In order to connect both support shafts 48 and 55 by connecting member 56, the gripping portions are fitted on the support shafts 48 and 55 after resiliently opening or spreading the opening portions 56*d* and 56*e*. In so doing, it is possible to achieve the connection by the gripping of the support shafts 48, 55 by corresponding gripping portions 56*b*, 56*c*.

In conventional carburetors, the play of the member interconnecting both support shafts 48 and 55 is eliminated by use of a coil spring which is adapted to bias the support shafts 48 and 55 towards each other. According to the described construction of the invention, it is possible to eliminate such coil spring and, hence, reduce the number of parts because the gripping portions 56*b*, 56*c* of the connecting member 56 tightly grip the support shafts 48 and 55 while allowing relative rotation therebetween.

Referring again to FIG. 6, a communication passage 60 provides communication between the space 59 above the sliding throttle valve 12 within the throttle valve guiding cylinder 13 and the upstream end of the intake passage 14, i.e. the air horn 19. The position of the opening of this communication passage 60 with respect to the space 59 is selected so that the communication passage 60 is closed by the sliding throttle valve 12 when the latter is opened to a large opening degree. A by pass passage 61 provides communication between the space 59 and the portion of the intake passage 14 downstream from the sliding throttle valve 12. The valve shaft 62 of a starting valve, adapted to be opened and closed by an operation shaft 74 which moves axially, is disposed at an intermediate portion of the by pass passage 61. A ball 64 biased by a spring 63 fits in a groove formed in the outer peripheral surface of the operation shaft 74 at an intermediate portion of the latter thereby to maintain the valve shaft 62 at the position to which it has been displaced, i.e. to hold the starting valve in the opened position.

Figure 9:
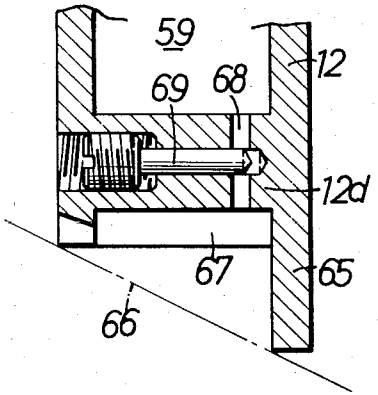
FIG. 9 is an enlarged sectional view of the bottom of the sliding throttle valve.
Figure 12:
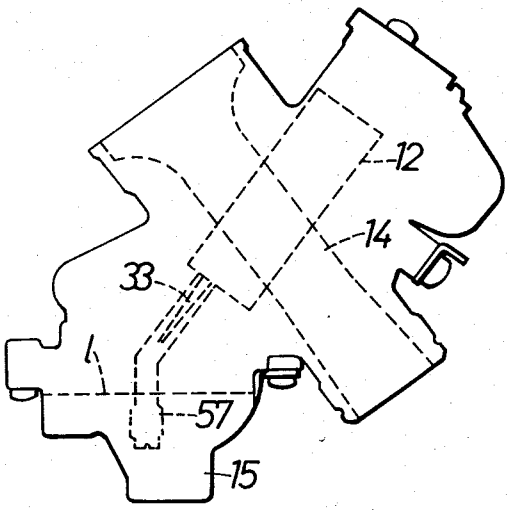
FIGS. 10, 11 and 12 are simplified illustrations for showing the problems which occur when the intake passage is inclined.
Figure 11:
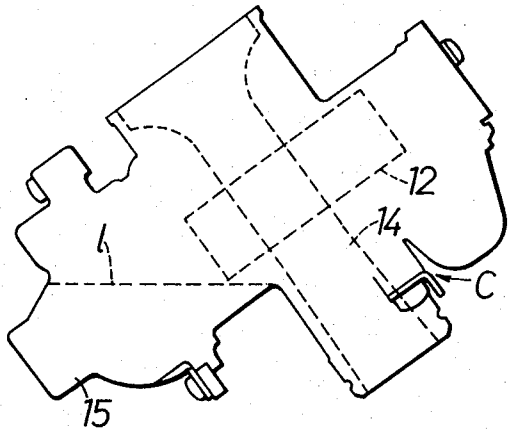
Figure 10:
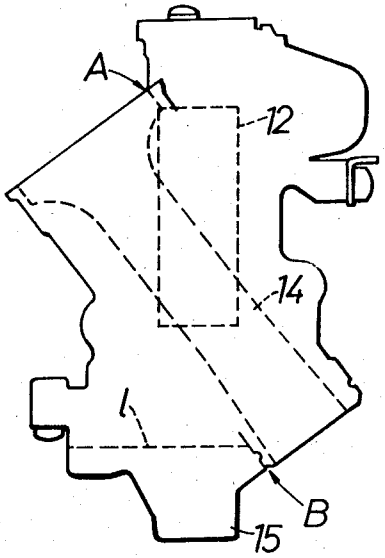

Referring now to FIG. 9, a downwardly depending portion 65 is formed on the bottom 12*d* of the sliding throttle valve 12 at the downstream end as viewed in the direction of flow of the intake air 21. The arrangement is such that an imaginary line 66, which connects the lower end of the depending portion 65 and the lower end of the upstream end of the bottom portion 12*d* intersects the bottom surface of the intake passage 14 opposite the bottom portion 12*d*, at a small cut-away angle of the order of several degrees. The selection of this cut-away angle is an important factor which affects the change in the intake air flow rate in small and medium throttle opening regions and, hence, the setting of the air-fuel ratio of the mixture in these regions.

A recess 67 is formed in the bottom portion 12*d* of the sliding throttle valve 12 so as to oppose the recess 28 formed in the intake passage 14. An auxiliary cut-away 80 is formed in the upstream side portion of the valve 12. Furthermore, as will be seen from FIG. 9, an air passage 68 is formed in the bottom portion 12*d* of the sliding throttle valve 12 so as to communicate with the space 59 and to open into the recess 67. In addition, a screw 69 is screwed into the bottom portion 12*d* so as to be movable in and out thereby to adjust the flow rate of the air in the air passage 68.

A hole for mounting the fuel needle valve is disposed upstream of the center of the recess 67.

By forming the recess 67 in the bottom portion 12*d* of the sliding throttle valve 12 as explained hereinabove, it is possible to reduce the vacuum acting on the main fuel nozzle port when the sliding throttle valve 12 is in the idle position, thereby to diminish the unfavorable effect of the phenomenon known as main idle, i.e. an increase of the fuel flow due to discharge from the main nozzle port, on the slow fuel system. In addition, in the carburetor of the invention, the fuel metering needle valve 33 takes a position adjacent to the upstream end within the recess 67, so that the main fuel passage 57 is correspondingly spaced from the slow fuel system. In addition, the suction head for the main fuel system from the fuel surface is greater than that for the slow fuel system. These features also contribute to the elimination of the unfavorable effect of the main fuel system on the slow fuel system. In addition, the sensitivity of adjustment of the rate of flow of the fuel from the main fuel nozzle port in relation to the change in the recess angle is increased because the main fuel nozzle port is disposed in the vicinity of the upstream end of the sliding throttle valve. Furthermore, the undesirable effect on the velocity of air flowing in the area above the main fuel nozzle port is diminished because the adjusting air passage 68 by-passing the intake passage 14 is disposed downstream of the main fuel nozzle.

The foregoing description of the carburetor C1 applies also to the other carburetors C2 and C3. Namely, in each of the carburetors C1 to C3, the central axis of the intake passage 14 substantially coincides with the bisector line of the angle formed between the first and second cylinder blocks CB1, CB2 and the third cylinder block CB3. By such arrangement, it is possible to simplify the connection between the carburetors C1 to C3 to the cylinder blocks CB1 to CB3 by employing common parts or members.

For attaining a synchronism of operation of the carburetors C1 to C3, the driving power transmitted to the shaft of the carburetor C2 through a throttle drum 70 is connected to the other carburetor C1 and C3 through synchronizers 71 and 72 which are known per se.

For driving the starting valve, the operation shaft 74 displaceably extends through the carburetor bodies 10 of the carburetors C1 to C3, and a starting knob 75 is fixed to the end of the operation shaft 74. Connecting plates 76, 77 and 78 corresponding to the drive shafts 62 of the carburetors C1 to C3 are fixed to intermediate portions of the operation shaft 74. These connecting plates 76 to 78 are connected to the drive shafts 62 of the corresponding carburetors. Therefore, as the starting knob 75 is pulled, the drive shafts 62 of the carburetors C1 to C3 are operated simultaneously to drive the starting valves in the opening direction.

Although the invention has been described with specific reference to an internal combustion engine having 3 cylinders, the invention can equally be applied to various multi-cylinder engines having cylinders of numbers other than 3.

As has been described, according to the invention, it is possible to arrange the intake passage at an inclination by disposing the sliding throttle valve guiding cylinder at an acute angle with respect to the upstream portion of the intake passage and by selecting the angle formed between the intake passage and the fuel surface in the portion of the float chamber upstream from the sliding throttle valve to be greater than said acute angle. In addition, by selecting the angle of intersection between the fuel surface and the sliding throttle valve to be an obtuse angle, it is possible to secure an appropriate position of the valve seat to permit a reduction in size of the carburetor. Furthermore, since the sliding throttle valve is arranged such that the line along which it operates substantially coincides with the angle bisector of the greater one of the angles formed between the fuel surface and the intake passage, it is possible to avoid the mutual interference between the intake passage and the sliding throttle valve guiding cylinder, as well as between the intake passage and the float chamber, without requiring any increase of the length of the intake passage and, hence, any undesirable effect on the intake characteristics of the engine.

Although the invention has been described in relation to a specific embodiment thereof, numerous modifications and and variations will become apparent to those skilled in the art which will not depart from the scope and spirit of the invention as defined in the appended claims.

Thus, it is essential in order to satisfy the objects of the invention that the angle between the sliding valve and the intake passage be an acute angle while the angle between the sliding valve and that portion of the fuel surface upstream of the sliding valve be greater than said acute angle and, preferable, be an obtuse angle. By way of particular example, the angle $\alpha$ can be of the order of 70° and therefore, preferably, the angle $\beta$ is 55° which is equal to $\frac{1}{2}$ of the supplementary angle of $\alpha$, i.e. 110°. Thereby, the line of operation of the sliding valve will bisect the supplementary angle of 110°. These values are merely intended to be exemplary and are not to be taken as limiting to the invention.

What is claimed is:

1. A sliding throttle valve type carburetor comprising a sliding throttle valve, an air intake passage and a fuel float chamber, said sliding throttle valve extending along a line of intersection with said intake passage and being disposed at an acute angle relative to the portion of said intake passage upstream from said sliding throttle valve, said sliding throttle valve forming an angle of intersection with the portion of the fuel surface in said float chamber upstream from said sliding throttle valve which is greater than said acute angle.

2. A sliding throttle valve type carburetor as claimed in claim 1, wherein said angle formed between said sliding throttle valve and the portion of said fuel surface in said float chamber upstream from said sliding throttle valve is an obtuse angle.

3. A sliding throttle valve type carburetor as claimed in claim 1, wherein said sliding throttle valve operates along a line which substantially coincides with the bisector of the greater of the angles formed between said fuel surface and said intake passage.

4. A sliding throttle valve type carburetor as claimed in claim 1, wherein said sliding throttle valve includes a fuel metering needle valve adapted to cooperate with a main fuel passage which is provided in linear extension of said line of operation of said sliding throttle valve.

5. A sliding throttle valve type carburetor as claimed in claim 4, wherein a slow fuel passage is provided parallel to said main fuel passage.

6. A sliding throttle valve type carburetor as claimed in claim 5, wherein said slow fuel passage and said main fuel passage open into said intake passage, said slow fuel passage opening into said intake passage downstream of the opening of said main fuel passage into said intake passage.

7. A sliding throttle valve type carburetor as claimed in claim 5, wherein said slow fuel passage has a suction head from the fuel surface in said float chamber to said intake passage which is less than the suction head of said main fuel passage.

8. A sliding throttle valve type carburetor as claimed in claim 5, wherein said intake passage has a wall with a recess and at least said main fuel passage opens into said recess.

9. A sliding throttle valve type carburetor as claimed in claim 8, wherein said recess has a rectangular or U-shaped form, in transverse section, is elongated in the direction of flow of the intake air in said intake passage and is open at its downstream end.

10. A sliding throttle valve type carburetor as claimed in claim 8, wherein said recess has a substantially L-shaped longitudinal section taken along said line of operation of said sliding throttle valve, said main fuel passage comprising a nozzle port disposed parallel to said line of operation of said sliding throttle valve adjacent the upstream end of said recess.

11. A sliding throttle valve type carburetor as claimed in claim 1 comprising a float in said float chamber having a support disposed upstream of said main fuel passage.

12. A sliding throttle valve type carburetor as claimed in claim 11 comprising a float valve operated by said float, and a valve seat for said float valve, said valve seat being disposed within the angular region formed between said intake passage and the fuel surface in said float chamber.

13. A sliding throttle valve type carburetor as claimed in claim 11 comprising a bore receiving said valve seat extending parallel to said main fuel passage.

14. A sliding throttle valve type carburetor as claimed in claim 11, wherein said float has the shape of a slice of a column.

15. A sliding throttle valve type carburetor as claimed in claim 1, wherein said sliding throttle valve has a rectangular cross-section.

16. A sliding throttle valve type carburetor as claimed in claim 15 comprising a fuel metering needle valve mounted on said sliding throttle valve in offset relation from the center of said rectangular cross-section in the upstream direction as viewed in the direction of flow of air in said intake passage.

17. A sliding throttle valve type carburetor as claimed in claim 15, wherein said rectangular cross-section of said sliding throttle valve has shorter sides extending in the direction of flow of the intake air.

18. A sliding throttle valve type carburetor as claimed in claim 15 comprising a fuel metering needle valve mounted on said sliding throttle valve to project downwardly therefrom so as to face said intake passage, driving means for said sliding valve including elements within the rectangular cross-section of said sliding throttle valve, said throttle valve having a lower surface provided with a recess and cut-away facing into said intake passage.

19. A sliding throttle valve type carburetor as claimed in claim 1 comprising a carburetor body, said intake passage including a first portion upstream of said sliding throttle valve which is integral with said carburetor body and a second portion downstream of said sliding throttle valve which is separate from said first portion, said second portion having a first surface slidably supporting said throttle valve, a second surface mounted against said carburetor body, and a step connecting said first and second surfaces, whereby said sliding throttle valve can be mounted in place and said upstream and downstream portions connected to form said intake passage.

20. A sliding throttle valve type carburetor comprising a body defining an air intake passage, a fuel float chamber on said body, means for supplying fuel into said float chamber to a given level to establish a fuel surface, and sliding throttle valve means slidably mounted in said body to extend across said air passage and being movable along a line of operation for controlling air flow through said passage and delivery of fuel thereto, said body including main fuel passage means extending rectilinearly from the float chamber to said air passage for delivering fuel to the air in said passage, said sliding throttle valve means including a fuel metering needle valve slidably received in said main fuel passage means in linear alignment therewith, said line of operation of said sliding throttle valve means forming an acute angle with the portion of the intake passage upstream of the sliding throttle valve means, and forming a greater angle with the portion of the fuel surface in the float chamber upstream of the intersection of said line of operation with said fuel surface.

21. A sliding throttle valve type carburetor as claimed in claim 20, wherein said means for supplying fuel into the float chamber comprises a float member in said float chamber controlling said fuel, and valve means coupled to the float member for controlling fuel flow to said float chamber, said valve means being located within the angular range between said fuel surface and said air passage.

22. A sliding throttle valve type carburetor as claimed in claim 21, wherein said angle formed between said sliding throttle valve means and the portion of said fuel surface in said float chamber upstream from said sliding throttle valve means is an obtuse angle.

23. A sliding throttle valve type carburetor as claimed in claim 22, wherein said line of operation of said throttle valve means substantially coincides with the angle bisector of the greater of the angles formed between said fuel surface and said intake passage.

* * * * *